United States Patent [19]

Hakansson

[11] Patent Number: 4,880,022

[45] Date of Patent: Nov. 14, 1989

[54] APPARATUS FOR TREATING SMALL ITEMS

[76] Inventor: Lars Å. H. Håkansson, Lindöhällsvägen 15, S-603 65 Norrköping, Sweden

[21] Appl. No.: 243,757

[22] Filed: Sep. 13, 1988

[30] Foreign Application Priority Data

Sep. 14, 1987 [SE] Sweden ..... 8703548

[51] Int. Cl.[4] ..... B08B 3/04

[52] U.S. Cl. ..... 134/120; 68/145; 134/132; 134/155

[58] Field of Search ..... 134/65, 120, 132, 153, 134/155, 159; 68/27, 58, 145

[56] References Cited

U.S. PATENT DOCUMENTS

| | | | |
|---|---|---|---|
| 1,806,957 | 5/1931 | Stocking | 134/132 |
| 2,628,461 | 2/1953 | Heyman | 134/132 X |
| 2,684,560 | 7/1954 | Swanson | 134/153 X |
| 3,001,338 | 9/1961 | Parker | 134/153 |
| 3,969,913 | 7/1976 | Schaper | 134/65 X |
| 4,719,933 | 1/1988 | Jackson | 134/132 X |

FOREIGN PATENT DOCUMENTS

| | | | |
|---|---|---|---|
| 144589 | 3/1965 | U.S.S.R. | 134/132 |

*Primary Examiner*—Philip R. Coe

*Attorney, Agent, or Firm*—Cushman, Darby & Cushman

[57] ABSTRACT

Apparatus for treating such small items as nails, screws, nuts and like objects including a treatment-liquid container (2) and a substantially cylindrical, rotatable drum (3), into which the items to be treated are introduced. The drum (3) is journalled for rotation at the upper part of the container (2) and one end of the drum is provided with a small-item infeed inlet (5) and a treatment-liquid outfeed outlet. The other end of the drum is provided with a small-item outfeed outlet and a treatment-liquid supply inlet (22). The drum (3) has provided on the inner surface of the drum shell transporting device in the form of ribs or like protrusions which extend helically around the rotational axis of the drum and which are effective in moving items from the small item inlet infeed (5) in a direction toward the small item outfeed outlet, as the drum (3) rotates.

5 Claims, 4 Drawing Sheets

APPARATUS FOR TREATING SMALL ITEMS

BACKGROUND OF THE INVENTION

The present invention relates to apparatus of the kind intended for treating small items or articles and comprising a treatment-liquid container and a substantially cylindrical, rotatable drum into which items to be treated are introduced.

The treatment of small items, for instance the surface treatment of such metal objects as screws, washers and like items, has previously been effected with the aid of perforated drums into which the items are introduced in batches. The drums are then lowered into various treatment-baths, with the aid of transporters. It is also known in the art to introduce such small items into various treatment-liquid baths while suspending the items on hangers or like suspension devices as said items being introduced to the bath with the aid of transporters constructed herefor.

One drawback with known apparatus of this kind resides in the amount of handling work that needs to be carried out in filling and emptying the drums and hanging-up and taking-down the items from the hangers and like suspension devices. Such handling takes a relatively long time to carry out, and greatly adds to the cost of the treatment.

SUMMARY OF THE INVENTION

The object of the present invention is to provide an apparatus for the treatment of small items with which the aforesaid drawbacks of known apparatus are not found and which will enable treatment to be carried out substantially continuously. This object is achieved by means of the inventive apparatus having the characteristic features that emerge in claim 1. Advantageous embodiments of the invention are set forth in the depending claims.

BRIEF DESCRIPTION OF THE DRAWINGS

The invention will now be described in more detail with reference to the accompanying drawings, in which.

DETAILED DESCRIPTION

Figure 1:
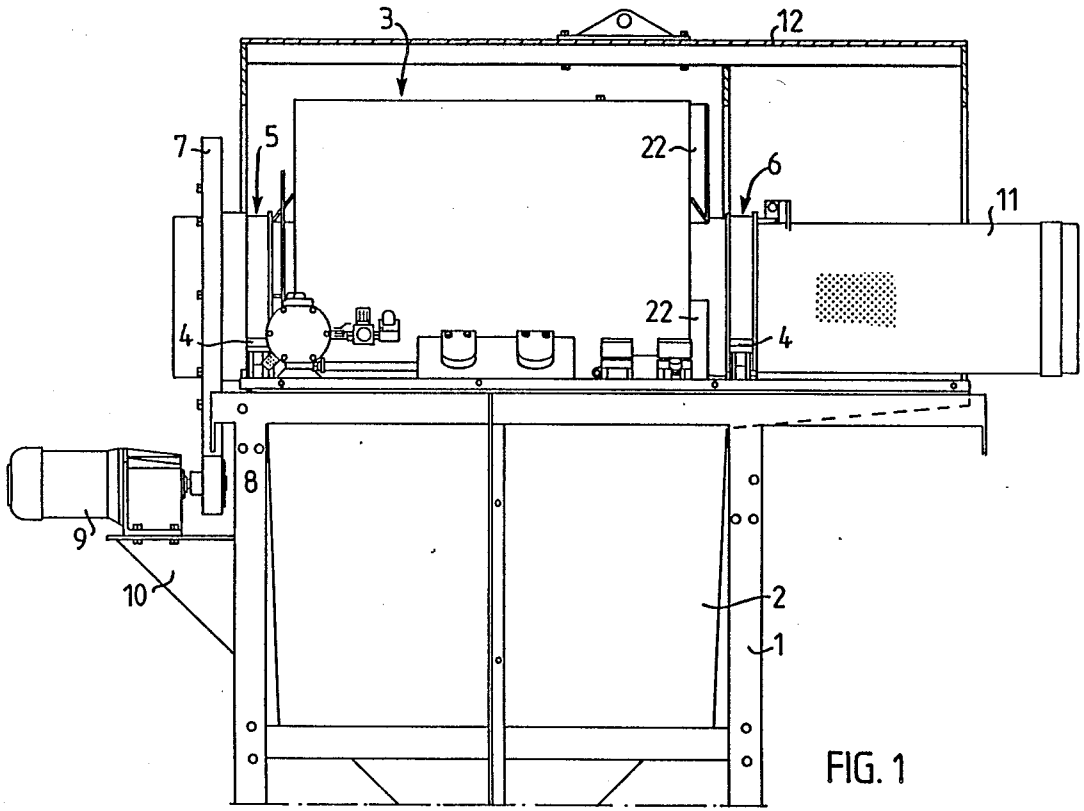
FIG. 1 is a side view of an embodiment of apparatus constructed in accordance with the invention.
Figure 2:
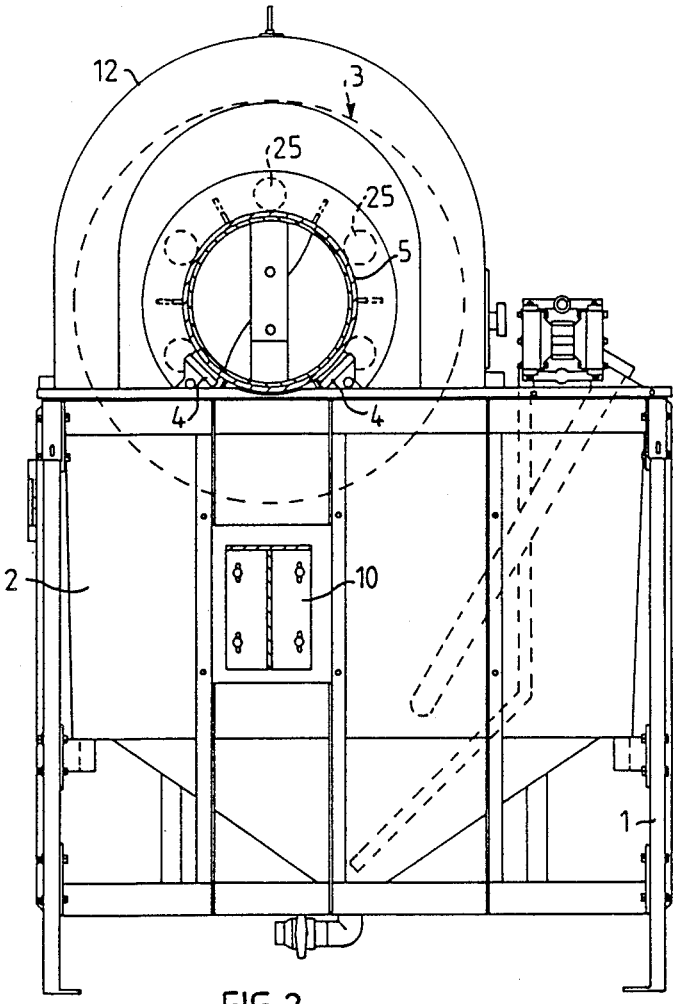
FIG. 2 is an end view of the apparatus shown in FIG. 1, seen from the left of said figure, said view being partly cut-away and having certain elements removed.

FIGS. 1 and 2 illustrate one embodiment of the inventive apparatus, which is mounted on a stand 1 incorporating an open-top container 2 for treatment liquid. A drum 3 is rotatably journalled in the upper part of the stand 1, in journals 4 which are mounted on the stand 1. The journals or bearings 4 of the illustrated embodiment comprise block or pillar bearings on which the drum 3 rests, although it will be understood that other types of bearings can be used. The position of the drum 3 in the vertical direction is such that part of the drum 3 will extend down into the container 2.

The drum 3 is provided with central, hollow-tubular extensions 5 and 6 at respective ends thereof, to facilitate journalling of the drum. Attached to the extension 5 is a gear 7 which co-acts with a pinion 8 on a motor 9 mounted on a bracket structure 10 on the frame 1 and intended for setting the drum 3 in rotation.

Mounted on the other extension 6 at the other end of the drum 3 is a perforated tube 11 which extends away from the drum 3. The perforated tube 11 is intended for preparatory drying of the small items subsequent to the passage through the drum 3, as hereinafter described in more detail.

The drum 3 and the perforated tube 11 are covered by a removable hood 12 from which the extention 5 and the outwardly located part of the perforated tube 11 project. This arrangement thus forms a unit which is essentially closed to the outer surroundings.

Figure 3:
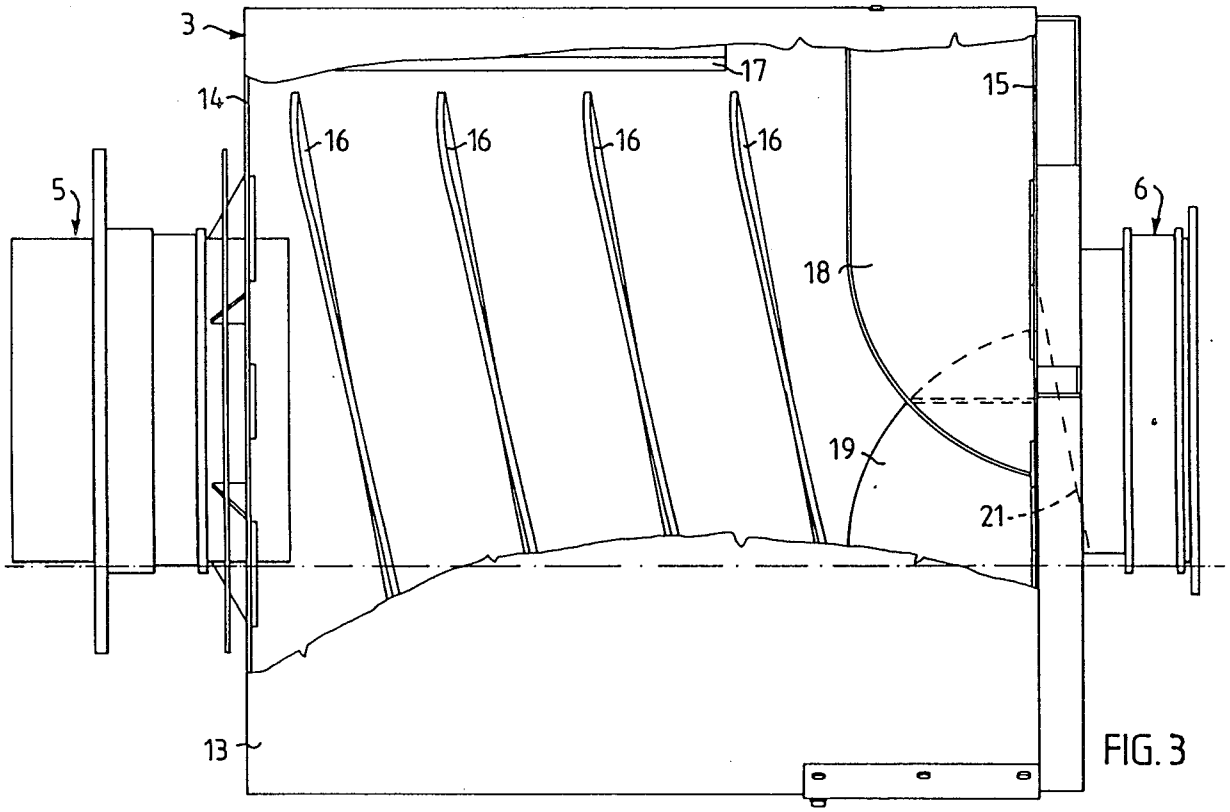
FIG. 3 is a partly cut-away side view of a drum forming part of the apparatus illustrated in FIGS. 1 and 2.
Figure 4:
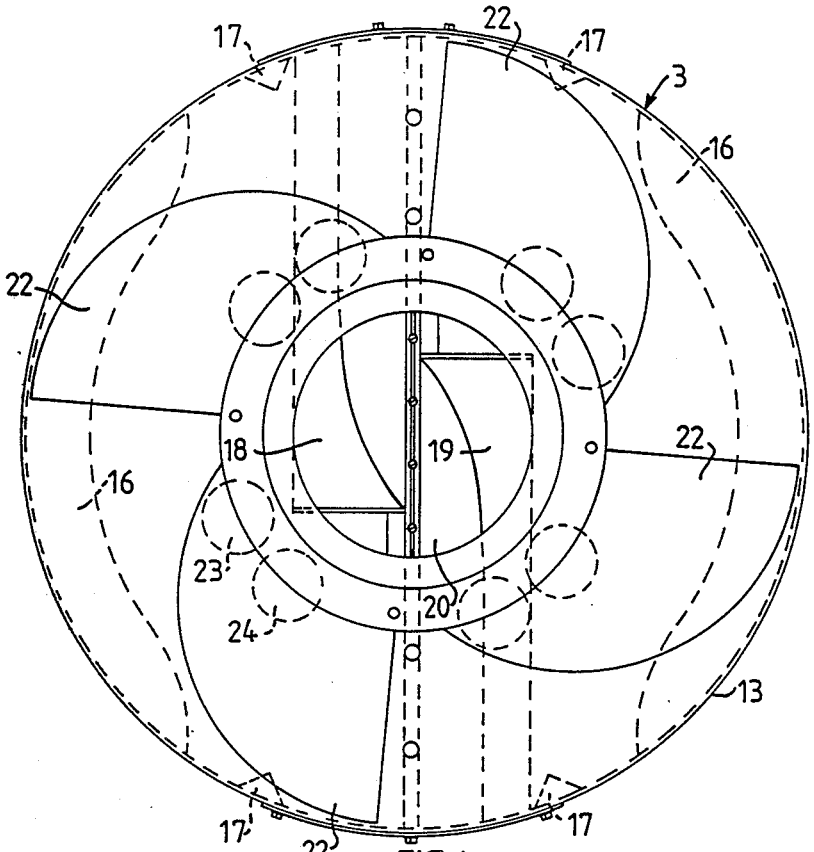
FIG. 4 is an end view of the drum shown in FIG. 3, seen from the right in FIG. 3.

FIGS. 3 and 4 illustrate the drum 3 in more detail and in a larger scale. As would be seen from FIGS. 3 and 4, the drum 3 of the illustrated embodiment is of cylindrical configuration and has a substantially impervious shell 13 and substantially impervious end walls 14 and 15. Provided on the inside of the shell 13 of the drum 3 are transporting devices or dogging devices in the form of ribs 16 which extend substantially radially inwards and extend in helical form around the rotational axis of the drum 3. The ribs 16 are intended to move the small items located within the drum in a direction from one end wall 14 to the other end wall 15 as the drum rotates. The ribs 16 of the illustrated embodiment do not extend continously around the shell 13, but are divided into groups. Thus is done in order to achieve improved mixing of the small items in the drum 3. In order to improve mixing of the items still further a number of further strips 17 which extend in the direction of the drum axis are arranged on the inner surface of the shell 13 between the aforesaid groups of ribs 16, these further ribs 17 forming obstacles to the small items and therewith enhancing the extent to which said items are mixed together as the drum rotates.

The extension 5 located at the end wall 14 of the drum 3 is of hollow-tubular configuration and is intended to form means for introducing small items into the drum 3. In this case, the items can be supplied in any desired manner, for instance from a treatment apparatus of the same kind used to carry out preceding treatment, or by means of suitable transporting devices. The items then fall down onto the inner surface of the shell 13 and are moved by the ribs 16 in a direction towards the end wall 15, as the drum 3 rotates. Located adjacent the end wall 15 are outfeed means for feeding the small items from the drum, said means having the form of two baffles or scoops 18 and 19 respectively arranged on the inside of the end wall 15 of the drum 3 and extending radially from the shell 13 inwardly and beyond the rotational axis of the drum 3 and extending axially from the end wall 15 to a location adjacent the end of the last rib 16. Thus, the baffles or scoops 18 and 19 will lift the items from the shell 13 as the drum rotates and move the items into the proximity of the rotational axis of the drum. The items are then discharged through a central opening 20 in the end wall 15 and exit into the tubular extension 6, which is provided with transporting ribs 21 whose function corresponds to the function of the ribs 16 in the drum 3, as indicated in FIG. 3. The small items are fed from the extension 6 into the perforated tube 11, which may also be provided with transporting ribs and which, because it is perforated, enables the treatment liquid to run from the items, through the perforated wall of the tube and back down into the container 2.

The treatment liquid is introduced into the drum 3 by means of supply devices located on the outside of the end wall 15 of said drum. In the case of the illustrated embodiment, the supply devices comprise a number of scoops 22, in the illustrated case four scoops, although it will be understood that a larger or smaller number of scoops can be used if so desired. Each scoop 22 of the illustrated embodiment extends from a location adjacent the opening 20 in the end wall 15 radially outwards to a location in the proximity of the shell 13. Each scoop 22 is intended to collect treatment liquid from the container 2 as the drum 3 rotates, and move the liquid radially inwards and deliver said liquid to the interior of the drum 3, through at least one opening 23, 24 in the end wall 15. The amount of treatment liquid delivered to the drum interior can be controlled by adjusting the level of liquid in the container 2 and by changing the speed at which the drum 3 rotates. The liquid level in the drum 3 is determined by the position of a multiple of outlet openings 25 in the end wall 14 of the drum 3 (see FIG. 1).

It is also possible to provide the container 2 with means for adjusting the level of treatment liquid such as to adjust the depth to which the radially outer end of the scoop or scoops 22 is submerged into the liquid and therewith controlling the flow of liquid through the drum 3.

The modus operandi of the illustrated arrangement would be understood from the aforegoing, and hence no functional description is necessary. It is possible when using the described apparatus to achieve a continuous flow of small items through the drum 3, and the perforated tube can be connected to the extension 5 of a similar apparatus forming a subsequent stage in the treatment of such items. The location of the scoops 22 for supplying treatment liquid to the drum means that the small items and the treatment liquid will move in counterflow, which is highly beneficial since the treatment liquid will always be at its cleanest at that location at which the items leave the drum 3.

The aforedescribed embodiments are not restrictive of the invention, since modifications and changes can be made within the scope of the following claims.

I claim:

1. Apparatus for treating small items and comprising:

a treatment-liquid container (2) and a substantially cylindrical, rotatable drum (3) into which small items to be treated are introduced;

the drum (3) being journalled for rotation at the upper part of the container (2) and being provided at one end with infeed means (5) for feeding the items into said drum and with treatment-liquid supply or outfeed means (22, 23, 24, 25), and at its other end being provided with item-outfeed means (18, 19, 20) and with treatment-liquid outfeed or supply means (25; 22, 23, 24);

the drum (3) being provided on an inner surface of a shell (13) thereof with transporting devices (16) in the form of strip means which extend helically around a rotational axis of the drum (3) and which are effective, as the drum (3) rotates, in moving said items from the infeed means (5) towards the item outfeed means (18, 19, 20);

the shell (13) of the drum (3) being substantially liquid-impervious; both opposite end walls (14, 15) provided on said drum being substantially liquid-impervious with the exception of said item infeed and outfeed means and treatment liquid supply and outfeed means respectively;

the treatment-liquid supply means comprising at least one scoop means (22) which is arranged on the outside of the end wall (15) of the drum (3) and which extends radially from an opening (23, 24) in one said end wall (15) and the radially outer end of which is located on a radius, which allows said end to be immersed in the treatment liquid in the container (2) upon rotation of the drum (3), such as to collect treatment liquid from the container and supply said liquid to the drum interior through said opening (23, 24) in said end wall (15).

2. Apparatus according to claim 1 wherein the outfeed means for feeding items from the drum (3) comprises at least one baffle (18, 19) which is arranged on the inside of one end wall (15) of the drum (3) and which extends radially from the shell (13) of the drum (3) to a central opening (20) located in said one end wall (15) and which also extends in the direction of the drum axis from the end wall (15) to the end of the transporting devices (16) such as to guide the items from the transport devices out through said central opening (20) as the drum (3) rotates.

3. Apparatus according to claim 1 wherein:

the treatment-liquid outfeed means comprises at least one opening (25) in the said end wall (14) of the drum (3), and in that the distance of each said opening (25) from the rotational axis of the drum (3) is such as to provide a desired liquid level in the drum (3).

4. Apparatus according to any of claim 1, wherein:

the drum (3) has provided on the inside of its shell (13) a plurality of axially arranged further strips (17) for mixing up the small items in the drum.

5. Apparatus according to claim 1, wherein:

the container (2) is provided with means for adjusting the level of treatment liquid such as to adjust the depths to which the radially outer end of said at least one scoop (22) is submerged into said liquid and thereby controlling the flow of liquid through the drum (3).

* * * * *